US006325657B1

(12) United States Patent
Schroer

(10) Patent No.: US 6,325,657 B1
(45) Date of Patent: Dec. 4, 2001

(54) CONTACT ELEMENT FOR CONNECTING A RIBBON CABLE WITH CIRCULAR CONDUCTORS AND ROTARY CONNECTOR WITH SUCH CONTACT ELEMENT

(75) Inventor: Frank Schroer, Weiden (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/407,765

(22) Filed: Sep. 29, 1999

(30) Foreign Application Priority Data

Sep. 30, 1998 (DE) ..... 198 44 869

(51) Int. Cl.[7] ..... H01R 4/24; H01R 4/26; H01R 11/20

(52) U.S. Cl. ..... 439/391; 439/164; 439/404

(58) Field of Search ..... 439/391, 164, 439/397, 894, 492, 404

(56) References Cited

U.S. PATENT DOCUMENTS

| | | | | |
|---|---|---|---|---|
| 3,189,863 | * | 6/1965 | Leach | 439/418 |
| 3,920,301 | * | 11/1975 | Roberts et al. | 439/398 |
| 4,046,446 | * | 9/1977 | Reavis, Jr. | 439/401 |
| 4,277,124 | | 7/1981 | Loose et al. | 439/398 |
| 4,327,956 | * | 5/1982 | Sitzler | 439/397 |
| 4,508,399 | * | 4/1985 | Dowling et al. | 439/404 |
| 4,527,857 | * | 7/1985 | Hughes et al. | 439/397 |
| 5,021,608 | * | 6/1991 | Hadfield | 439/492 |
| 5,041,007 | | 8/1991 | Liu et al. | 439/164 |
| 5,059,134 | | 10/1991 | Schauer et al. | 439/404 |
| 5,174,782 | * | 12/1992 | Bogiel et al. | 439/404 |
| 5,190,468 | * | 3/1993 | Nichols, III et al. | 439/404 |
| 5,230,713 | * | 7/1993 | Schauer | 439/164 |
| 5,520,550 | * | 5/1996 | Okabe | 439/404 |
| 5,536,182 | | 7/1996 | Atoh et al. | 439/404 |
| 5,645,441 | | 7/1997 | Okuhara et al. | 439/164 |
| 5,833,486 | * | 11/1998 | Shinozaki | 439/404 |
| 5,888,088 | * | 3/1999 | Kobayashi et al. | 439/404 |
| 6,065,994 | * | 5/2000 | Hashim et al. | 439/404 |

FOREIGN PATENT DOCUMENTS

| | | |
|---|---|---|
| 41 19 769 A1 | 5/1992 | (DE) . |
| 296 22 991 U1 | 11/1997 | (DE) . |
| 197 04 155 A1 | 8/1998 | (DE) . |
| 0 486 867 A1 | 5/1992 | (EP) . |
| 0 698 943 A1 | 2/1996 | (EP) . |

OTHER PUBLICATIONS

Japanese Patent Application No. JP 09134748 A dated May 20, 1997, Patent Abstracts of Japan.

* cited by examiner

*Primary Examiner*—Tulsidas Patel
*Assistant Examiner*—Hae Moon Hyeon
(74) *Attorney, Agent, or Firm*—Sughrue, Mion, Zinn, Macpeak & Seas, PLLC

(57) ABSTRACT

A contact element is proposed for connecting a ribbon cable (10) with circular conductors (5, 7) wherein the contact element comprises a plurality of mutually insulated parallel conductor strips (20) made of a conductive material, to the one end of which a circular conductor (5, 7) can be attached and the other end of which is provided with a surface (21) to which a strand of the ribbon cable (10) can be fixed through a material connection. A conductor strip (20) has at least one pair of blades (29) between which a circular conductor (5, 7) can be inserted under termination. Furthermore, a rotary connector with such a contact element is described.

19 Claims, 3 Drawing Sheets

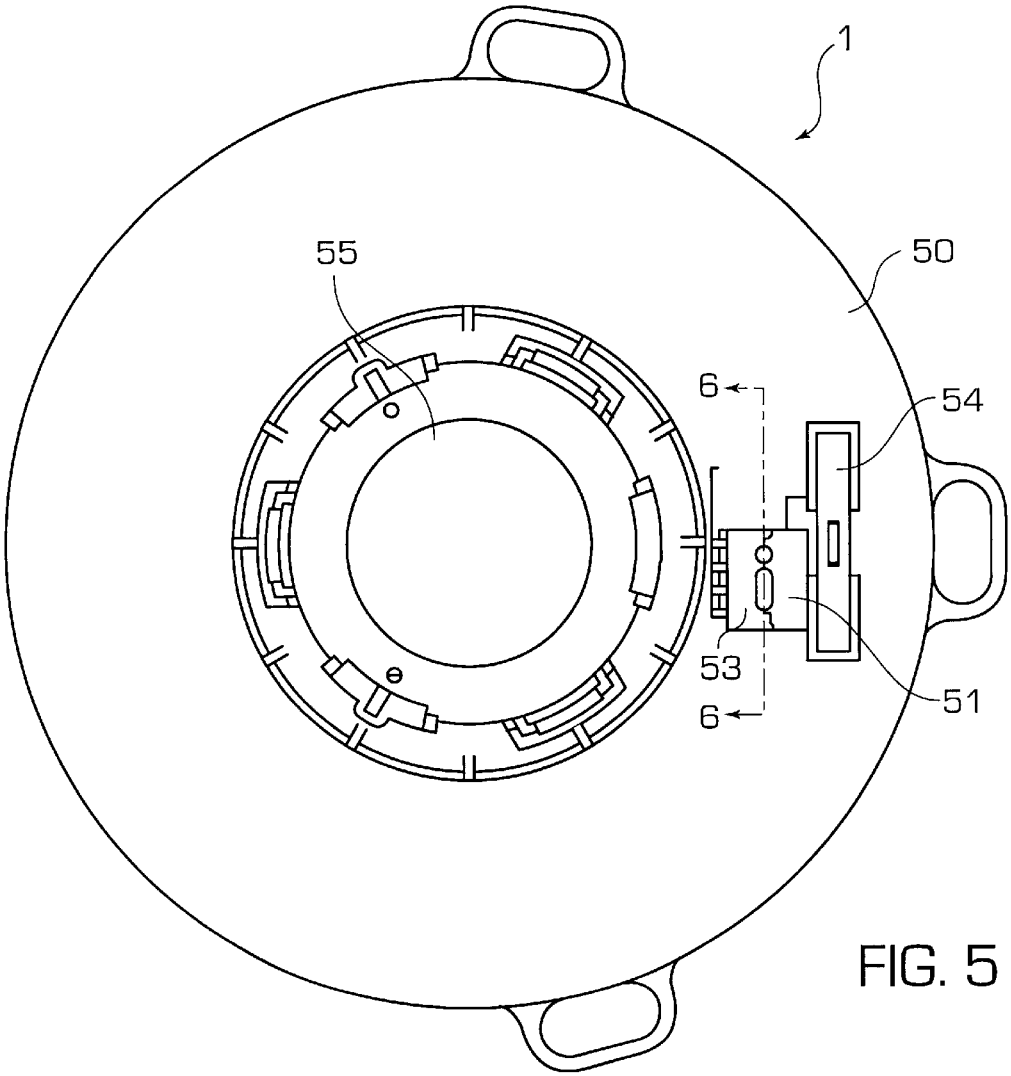
FIG. 5
FIG. 6
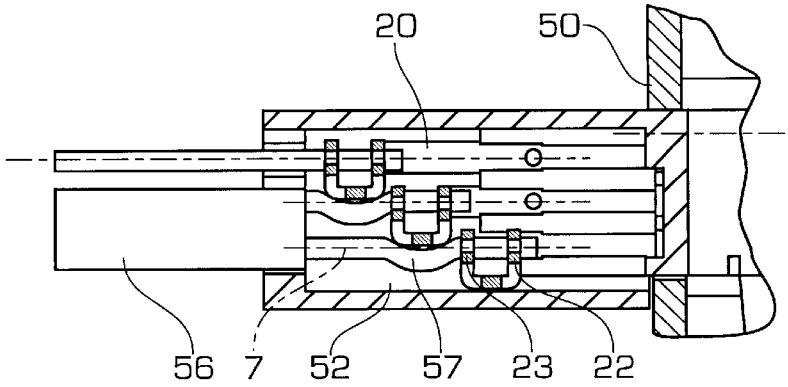

CONTACT ELEMENT FOR CONNECTING A RIBBON CABLE WITH CIRCULAR CONDUCTORS AND ROTARY CONNECTOR WITH SUCH CONTACT ELEMENT

BACKGROUND OF THE INVENTION

This application is based on and claims the benefit of German Patent Application No. 198 44 869.4. filed on Sep. 30, 1998.

The invention relates to a contact element for connecting a ribbon cable with circular conductors, whereby the contact element comprises a plurality of mutually insulated parallel conductor strips made of a conductive material, to the one end of which a circular conductor may be attached and the other end of which is provided with a surface to which a strand of the flat ribbon cable may be fixed through a material connection, as well as a rotary connector with such a contact element.

Interference-free power or signal transmission between parts of a device that are rotatable with respect to each other within a limited angular range is a problem frequently encountered. For example, a permanently secure power supply for triggering the airbag in the steering wheel of a motor vehicle is of decisive importance. Since sliding contacts, due to wear and fluctuating contact resistances, are unsuitable for this purpose, rotary connectors with ribbon cables have been developed to ensure a reliable connection.

The ribbon cable (hereinafter referred to as FBL) is disposed in the gap between two mutually rotatable housing parts of the rotary connector and fixed to both housing parts by its end faces. Preferred is a flat ribbon cable made of one or a plurality of flexible metal strips spaced at a distance from each other and embedded between two plastic strips. In the simplest case, the FBL extends helically like a clock spring within the gap. When the housing parts are rotated relative to each other, the diameter and the number of the turns changes as a function of the direction of rotation. Alternatively, the turns of the FBL extend along the radially inner and outer wall of the gap with opposite sense of rotation, whereby a reversal point is provided between the two cable sections. In this case, as the housing parts of the connector are rotated relative to each other, the cable is unwound from the one wall and taken up by the other wall. It is also known to dispose guide elements or elastic elements within the gap and to make the FBL from an elastic material to ensure reliable guidance as the housing parts are rotated relative to each other and to prevent damage.

Generally, the rotary connector is externally connected by circular conductors, i.e., wires or flexible leads with an at least approximately circular cross-section. Accordingly, a contact element is required for the electrical connection of the circular conductors and the strands of the ribbon cable. DE 41 19 769 A1 discloses a rotary connector with such a contact element. This contact element comprises several parallel mutually insulated metal strips that are connected to the strands of the FBL, for example by soldering or welding. The opposite ends of the conductor strips are made as plug contacts into which counter contacts connected with the circular conductors may be plugged. The disadvantage, however, is that this construction requires the prefabrication of the circular conductors with corresponding counter contacts, which is not only high in labor, but also requires tools for manufacturing and mounting the counter contacts. Furthermore, it increases the number of connecting points in the course of the cable and thus the risk of faulty contacts, particularly if the contacts are exposed to constant vibrations in a motor vehicle.

SUMMARY OF THE INVENTION

Against this background, the object of the invention was to develop a contact element for reliably connecting circular conductors with a ribbon cable, which is simple to manufacture and contact.

This object is attained by the invention in that a conductor strip has at least one pair of blades between which a circular conductor can be inserted under termination.

One basic idea of the invention is to attach the circular conductors directly to the contact element's conductor strips, which are preferably made of a metal. Insulation piercing terminals, into which the circular conductors are inserted, permit simple and rapid contacting. A suitable distance between blades ensures permanently reliable contact between the circular conductor and the conductor strip, whereby the use of an insertion tool permits a comparatively high clamping force. Since the circular conductor does not need to be stripped prior to insertion into an insulation piercing terminal, contacting is made significantly easier.

Depending on the desired alignment of the contact element or its conductor strips and the outgoing conductors, the blades may be arranged in the plane of the strips. It is preferred, however, to position the blades outside the plane of the strips, for example, perpendicularly thereto. Furthermore, two or several pairs of blades may be provided for contacting a circular conductor to ensure a permanently secure connection even in the case of vibrations and alternating loads such as those that occur, in particular, in a motor vehicle.

The connection between the contact element and the FBL is effected through the materials, whereby a conductor strip preferably has a level surface, e.g., a tongue, to which a strand of the FBL is fixed. Soldering or welding are particularly suitable, for example spot welding or ultrasonic welding. Advantageously, the width of this surface approximately corresponds to or slightly exceeds the width of the FBL strand. For the FBL, a flat conductor ribbon cable made of strip-shaped copper conductors laminated between two plastic foils or deposited onto a plastic foil is particularly suitable.

In a preferred embodiment of the invention, the conductor strips of the contact element are one-piece stampings to permit cost-effective production. Advantageously, the insulation piercing terminals are also formed during this stamping process. Individual areas of the conductor strip may be turned out, for example in the area of the insulation piercing terminals to obtain the desired arrangement of the outgoing circular conductors and the FBL. To fix the conductor strips of the contact element relative to each other, the conductor strips are connected by means of one or a plurality of insulating supports. The conductor strips are preferably fixed in a common support. As an alternative to the use of a prefabricated support made of one or several components, the conductor strips, after stamping, may be extrusion coated with liquid plastic, which hardens into the support.

The invention furthermore proposes that the conductor strips, prior to being fixed by the supports, be connected by at least one bridge. This simplifies the production of the contact element since only one part has to be handled whose conductor strips are attached to each other by one or several supports. This bridge is subsequently removed, e.g., by stamping. This requires that it be accessible from the outside after the conductor strips have been fixed within a support. The bridge may be disposed, for instance, in an area of the conductor strips protruding beyond a support.

The bridge is preferably integrated with the conductor strip to permit all conductors of the contact element to be produced together, for example in one stamping process. The bridge is advantageously arranged at the end of the conductor strip that is intended for the attachment of the ribbon conductor. This prevents the bridge from interfering with the formation of the insulation piercing terminals as well as any turnouts required in this area. The formation of the insulation piercing terminals frequently requires them to be formed from a strip section that is wider than the remaining parts of the conductor strip. The invention therefore proposes mutually to offset the insulation piercing terminals of adjacent conductor strips in longitudinal strip direction. Particularly if during formation of the strip, the area of the insulation piercing terminals is folded up from the plane of the strip, there is a wide variety of possible arrangements of the insulation piercing terminals, which are offset above, next to, or behind each other as a function of the fold. For this purpose, the length of adjacent conductor strips of the contact elements, the location and/or the direction of the fold may differ. This permits a space-saving arrangement of the conductor strips even if the section that is shaped into the insulation piercing terminals significantly exceeds the width of the rest of the strip. Thus, the offset makes it possible to produce all the conductor strips of the contact element from sheet metal with tight spacing to save material.

For space reasons, it is furthermore suitable to form the insulation piercing terminals from a strip section that essentially protrudes over the strip edge on one side. It is feasible, however, that the opposite strip edge has slightly protruding areas, provided that the protrusion is smaller than the distance between strips.

A conductor preferably has recesses in those angled areas that are formed by bending. This embodiment is suitable, for example, if the conductor strip is produced from a one-piece blank. In addition to providing material savings, this improves the flexibility of the material. Bending may be carried out during or after stamping of the blank.

Particularly if the contact element is used in a rotary connector, it is usually advantageous if the conductor strips are bent in the plane of the strip. In this manner, the circular conductors can be contacted outside the winding plane of the ribbon cable such that the radial diameter of the rotary connector can be limited to the space required for receiving the windings. The conductor strips may for instance be bent at a right angle. It is also feasible, however, to use a contact element with straight conductor strips and to effect the corresponding bending by folding the ribbon conductor.

To arrange the contact element in a rotary connector, a seat may be disposed in an outer wall of the rotary connector, for example, the radially outer wall or an axial wall. If the walls do not provide sufficient space to insert such a seat, an extension of a housing part may be provided with a corresponding seat. It is also conceivable to provide one or both ends of the FBL of the rotary connector with a contact element as described.

The contact element is preferably locked into the seat. Suitable for this purpose are for instance spring arms provided with barbs between which the contact element is inserted, preferably together with its support.

The invention furthermore proposes to seal the seat with a cover to prevent the unintended detachment of the contact element. This cover can be fastened to the rotary connector, for example, by interlocking or by insertion into guides. Even in connection with a cover, however, additional locking of the contact element within the seat is advantageous so as to fix the contact element in position during assembly of the rotary connector prior to adding the cover.

To prevent strains on the connection with the contact element, it is advantageous to provide strain relief of the FBL between the contact element and its windings. Suitable, in particular, is a strain relief provided by the cover. It is advantageous, for example, if the cover presses a section of the FBL against a surface of a housing part. To enhance the strain relief, the cover and/or the surface of the housing part are preferable provided with a roughened, for instance corrugated surface in the pressing area. Likewise, the cover can also provide strain relief for the circular conductors.

BRIEF DESCRIPTION OF THE DRAWING

In the following part of the specification, an exemplary embodiment of the invention is explained in detail by means of the drawing, which shows:

FIG. 5: a top view of the inner housing part of the rotary connector

FIG. 6: a section along line A—A in FIG. 5

DETAILED DESCRIPTION OF THE INVENTION

Figure 1:
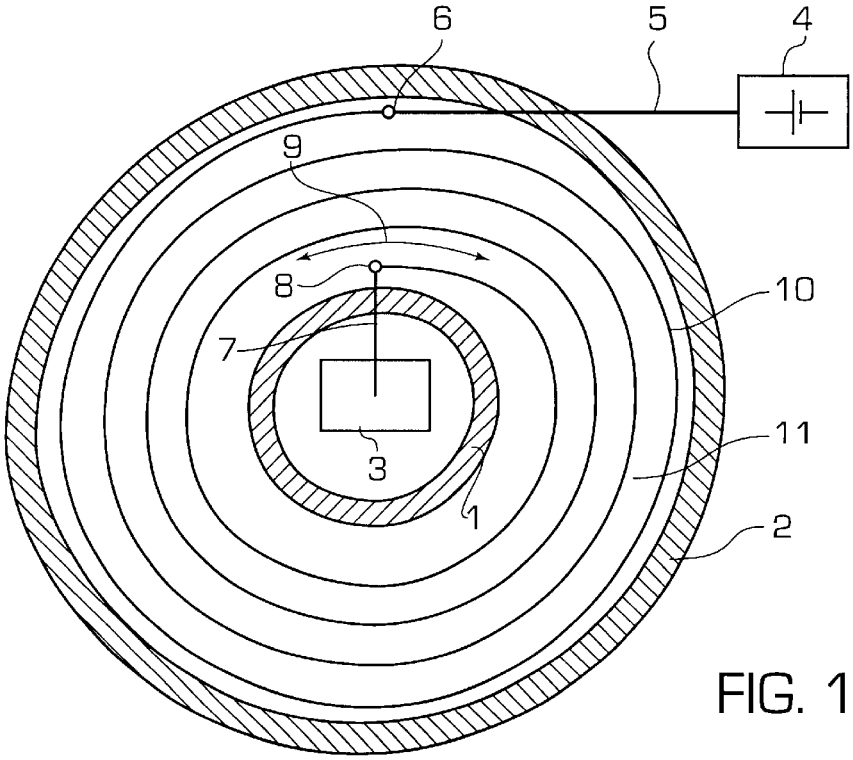
FIG. 1: a schematic cross-section through a rotary connector

FIG. 1 schematically shows the construction of a rotary connector. This connector comprises an inner housing part (1) and an outer housing part (2), which are rotatable with respect to each other. The rotary connector serves, for instance, to power an airbag in the steering wheel of a motor vehicle, whereby the inner housing part (1) is mounted on the steering axle. The rotary connector connects the igniter (3) of the airbag to an electronic trigger (4), which is permanently mounted on the vehicle body and electrical power is supplied by the vehicle battery or the vehicle's electrical distribution system. The igniter (3) and the electronic trigger (4) are connected with the rotary connector via circular conductors (5, 7), which are connected to a ribbon cable (10) at connection points (6, 8). The ribbon cable (10) extends in windings like a clock spring within the gap (11) of the housing parts (1, 2). If the latter are rotated with respect to each other in the direction of the double arrow (9), the number and the diameter of the windings of the FBL (10) change. A sufficiently long FBL (10) thus ensures an end-to-end electrical connection between the housing parts (1, 2) through a limited number of windings.

Figure 2:
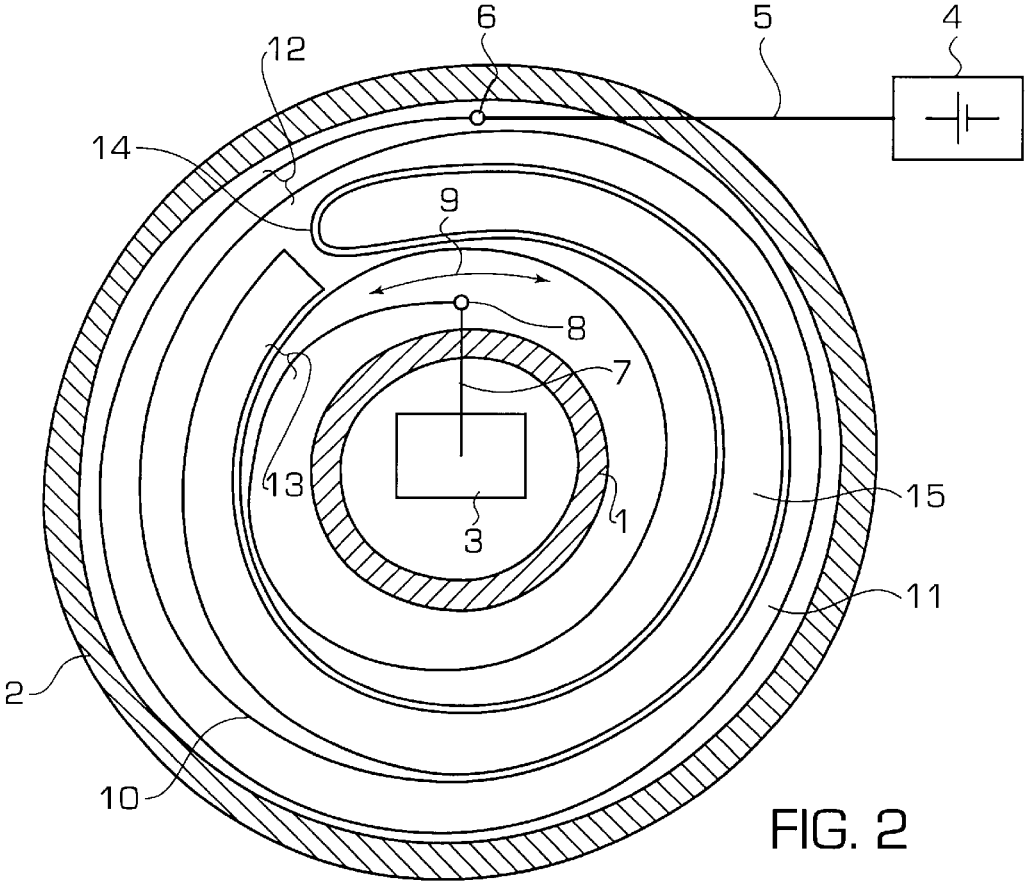
FIG. 2: a schematic cross section through an alternative embodiment

FIG. 2 schematically shows an alternative embodiment of the rotary connector, in which a first section (12) of the FBL (10) has an opposite winding direction along the wall of the outer housing part (2) compared to that of the second section (13) on the wall of the inner housing part (1). Between the two sections (12, 13), there is a reversal point (14) of the FBL (10). When the housing parts (1, 2) are rotated relative to each other in the direction of the double arrow (9), one of the sections (12, 13) is unwound and the other section (13, 12) takes up the FBL (10) as a function of the direction of rotation. To increase the functional reliability, a guiding member (15) may be provided.

Figure 3:
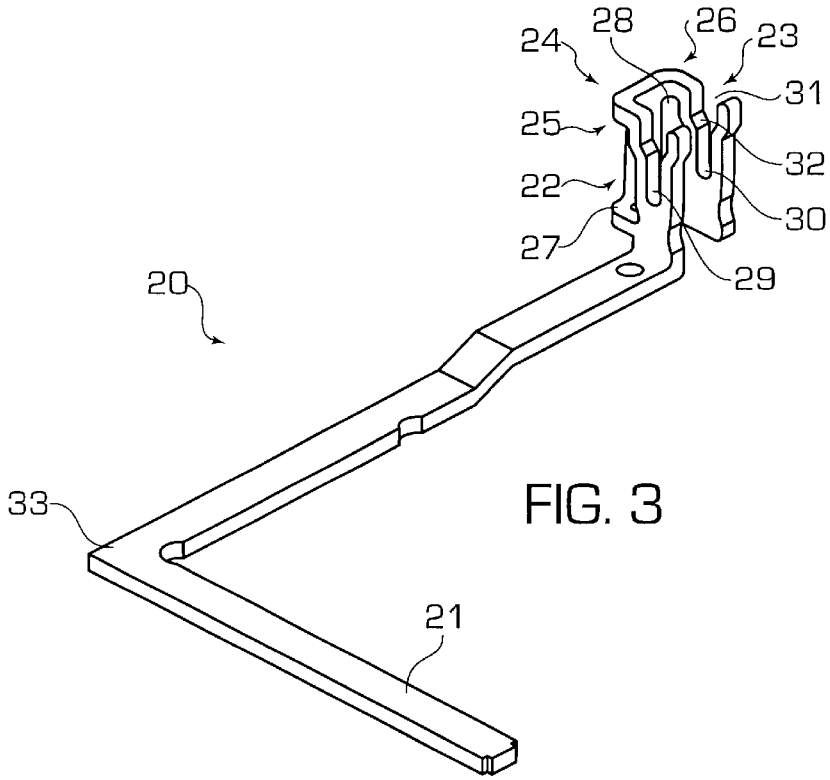
FIG. 3: a view of a conductor strip of the contact element

FIG. 3 shows a view of a conductor strip (20) of a contact element. The contact element is formed by several such conductor strips (20), which are embedded parallel to each other in a support. At its one end, the conductor strip (20) has a surface (21) suitable for contacting the strand of a flat conductor ribbon cable, for example, by welding or soldering. The opposite end of the conductor strip (20) is formed by a pair of insulation piercing terminals (22, 23) serving to contact a circular conductor. These are disposed in a section (24) of the conductor strip (20) in which the material is folded up several times perpendicularly to the plane of the strip. In bent areas (25, 26), the conductor strip is provided with recesses (27, 28) to facilitate its shaping.

The distance between the blades (29) in the insulation piercing terminals (22, 23) increases from their base (30) toward their opening (31). Preferably, there are two areas with different, each approximately constant distance between blades, which are separated from each other by a slanted shoulder (32). This makes it possible to pre-fasten the circular conductor with the insulation in the wider area between the blades (29) near the opening (31) prior to being pressed into the narrower area for contacting by piercing its insulation by means of a tool near the base (30) of the insulation piercing terminal (29). It is frequently advantageous to provide a bend (33) in the plane of the conductor strip (20), which makes it possible to dispose the insulation piercing terminals (22, 23) outside the plane of the to windings of the FBL (10).

Figure 4:
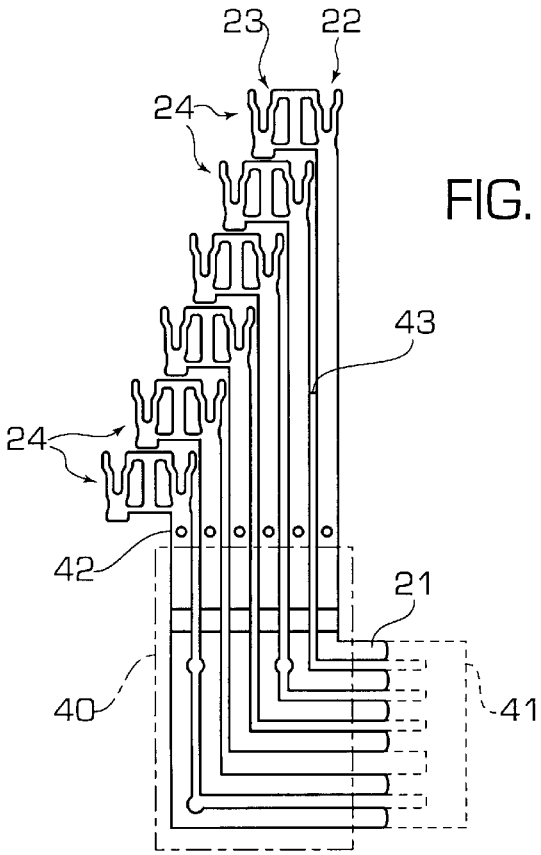
FIG. 4: a stamping for the contact element

The production process will now be explained by means of FIG. 4 showing a stamping, which can be shaped into the conductor strips (20) of a contact element. The part shown is first die cut from sheet metal which is, for instance, 0.2–1 mm thick. Then the area (40) of the stamping defined by the dash-dotted line is extrusion coated with a plastic to form the support of the contact element. After extrusion coating, the individual conductor strips (20) of the contact element are fixed in their position with respect to each other. Accordingly, this position is maintained when the bridge (41) indicated by the dashed line is removed such that the individual conductor strips (20) are insulated from each other. The end sections (24) of the conductor strips (20) with the insulation piercing terminals (22, 23) are bent as shown in FIG. 3 to receive the circular conductor.

To reduce the material requirements for the stamping and to permit a space saving arrangement of the conductor strips (20) in the contact element, the sections (24) with the insulation piercing terminals (22, 23) are mutually offset on adjacent conductor strips. Accordingly, the lengths of adjacent conductor strips (20) differ and after folding of the sections (24) their insulation piercing terminals (22, 23) are offset like steps above, next to or behind each other. Since the protrusion of the sections (24) beyond the side edge (42) exceeds the distance (43) between adjacent conductor strips (20), the sections (24) have to protrude on one side beyond an edge (42) of the conductor strip (20).

In the embodiment shown in FIG. 4, the offset of the sections (24) of adjacent conductor strips (20) is constant with respect to amount and operational sign over the entire width of the contact element. Alternative embodiments are possible, however. For example, the central conductor strips (20) can be the longest, whereas the length of the conductor strips (20) toward the two edges of the contact element decreases. In the latter case, it is also possible to arrange the sections (24) with the insulation piercing terminals (22, 23) in mirror symmetry to the longitudinal axis of the contact element.

FIG. 5 shows a top view of the inner housing part (1) of a rotary connector as claimed by the invention. An extension (51) for receiving the contact element is formed onto the top surface (50) of the rotary connector. The seat (52) inside the extension (51) is sealed with a cover (53). The housing part (1) is furthermore provided with a flexible element (54), which prevents play with respect to a component mounted thereon, particularly the steering wheel of a vehicle. The opening (55) in the center of the housing part (1) is intended to receive a steering column.

The cross-section of FIG. 6 shows the contact element with three conductor strips (20) in its seat (52). Two circular conductors (7) are combined into a cable by a common jacket (56), while the third is run individually. The space saving arrangement makes it necessary to run each circular conductor (7) in an arc (57) around the turned-out section (24) of the adjacent conductor strip (20) before it is received by the insulation piercing terminals (22, 23) of the associated conductor strip (20).

This creates a contact element for connecting a ribbon cable with circular conductors, particularly for a rotary connector, which can be easily and cost-effectively produced and reliably contacted.

What is claimed is:

1. An electrical connection assembly, comprising a contact element having a plurality of mutually insulated parallel conductor strips made of a conductive material, the conductor strips connected at one end to a ribbon cable (10) and at the other end to respective circular conductors (5, 7); and wherein each conductor strip (20) has at least one pair of blades (29) between which the respective circular conductor (5, 7) is inserted under termination; and wherein each conductor strip comprises insulation piercing terminals that include said at least one pair of blades for each conductor strip; wherein a width of each insulation piercing terminal is wider than a width of the respective conductor strip; and wherein the insulation piercing terminals of adjacent conductor strips are mutually offset in a longitudinal direction of the conductor strips, with corresponding different axial lengths of the respective conductor strips.

2. The electrical assembly in accordance with claim 1, characterized in that the conductor strips (20) are a one-piece stamping.

3. The electrical assembly in accordance with claim 1, characterized in that the conductor strips (20) are fixed in a common support.

4. The electrical assembly in accordance with claim 1, characterized in that the conductor strips (20) are connected by a bridge (41) prior to being fixed in a support.

5. The electrical assembly in accordance with claim 4, characterized in that the bridge (41) is disposed on the ribbon conductor side end of the conductor strips (20).

6. The electrical assembly in accordance with claim 1, wherein each conductor strip comprises insulation piercing terminals that include said at least one pair of blades for each conductor strip, and wherein the insulation piercing terminals (22, 23) are formed by a section (24) of the conductor strip (20), which protrudes on one side beyond the conductor strip's edge (42).

7. An electrical connection assembly, comprising a contact element having a plurality of mutually insulated parallel conductor strips made of a conductive material, the conductor strips connected at one end to a ribbon cable (10) and at the other end to respective circular conductors (5, 7); and wherein each conductor strip (20) has at least one pair of blades (29) between which the respective circular conductor (5, 7) is inserted under termination; and characterized in that each conductor strip (20) has a recess (27, 28) in a bent area (25, 26), and wherein each conductor strip comprises insulation piercing terminals that include said at least one pair of blades for each conductor strip; wherein a width of each insulation piercing terminal is wider than a width of the respective conductor strip; and wherein the insulation piercing terminals of adjacent conductor strips are mutually offset in a longitudinal direction of the conductor strips, with corresponding different axial lengths of the respective conductor strips.

8. The electrical assembly in accordance with claim 1, characterized in that a conductor strip (20) has a bend (33) in its plane.

9. The electrical assembly in accordance with claim 1, characterized in that each conductor strip (20) has a recess (27, 28) in a bent area (25, 26).

10. A rotary connector with two housing parts (1, 2) rotatable with respect to each other and connected by a flexible ribbon cable (10) which extends in windings in a gap (11) of the housing parts (1, 2), said flexible ribbon cable attached by its ends to a contact element that connects a strand of the ribbon cable (10) with a circular conductor (5, 7) and that is arranged in a seat disposed in at least one of the two housing parts; and wherein the contact element comprises a plurality of mutually insulated parallel conductor strips (20) made of a conductive material; and wherein one end of one of the insulated conductor strips is attached to the circular conductor (5, 7) and the other end is provided with a surface (21) to which a strand of the ribbon cable (10) is fixed through a material connection, wherein said one of the insulated conductor strips (20) has at least one pair of blades (29) between which the circular conductor (5, 7) is inserted under termination; wherein each of the other conductor strips has at least one pair of blades for inserting circular conductors and arranged such that the pair of blades of adjacent conductor strips are mutually offset in a longitudinal direction of the conductor strips with corresponding different axial lengths of the respective conductor strips; and wherein each conductor strip comprises insulation piercing terminals that includes said at least one pair of blades, wherein a width of each insulation piercing terminal is wider than a width of the respective conductor strip.

11. A rotary connector in accordance with claim 10, characterized in that the contact element is disposed in a recess of an outer wall or in an extension at least one of the housing parts (1, 2).

12. The electrical assembly in accordance with claim 1, wherein the conductor strips are connected to the ribbon cable by one of welds and solder joints.

13. The electrical assembly in accordance with claim 12, wherein the ribbon cable has flat conductor strands that are connected to the conductor strips.

14. The electrical assembly in accordance with claim 1, wherein each conductor strip is bent at an angle so as to run in at least two directions within a same plane, and wherein the conductor strips run parallel to each other within the same plane in which each conductor strip runs in at least two directions.

15. The electrical assembly in accordance with claim 1, wherein each conductor strip comprises at one end of the conductor strip insulation piercing terminals that include said at least one pair of blades, and at the other end of the conductor strip a non-piercing terminal.

16. The electrical assembly in accordance with claim 10, wherein the conductor strips are fixed to the ribbon cable by one of welds and solder joints.

17. The electrical assembly in accordance with claim 16, wherein the ribbon cable has flat conductor strands that are connected to the conductor strips, respectively.

18. The electrical assembly in accordance with claim 10, wherein each conductor strip is bent at an angle so as to run in at least two directions within a same plane, and wherein the conductor strips run parallel to each other within the same plane in which each conductor strip runs in at least two directions.

19. The electrical assembly in accordance with claim 10, wherein each conductor strip comprises at one end of the conductor strip said insulation piercing terminals that include said at least one pair of blades, and at the other end of the conductor strip a non-piercing terminal.

* * * * *